United States Patent [19]

Luce et al.

[11] 4,190,777

[45] Feb. 26, 1980

[54] POSITION SENSOR FOR ROTATABLE LAMP CHANGER TURRET

[75] Inventors: Dan G. Luce; William R. Klein, both of Houston; Richard D. Krenke, Katy, all of Tex.

[73] Assignee: Tideland Signal Corporation, Houston, Tex.

[21] Appl. No.: 930,308

[22] Filed: Aug. 2, 1978

[51] Int. Cl.[2] ..... H01H 3/00; H05B 39/10

[52] U.S. Cl. ..... 307/139; 315/89; 362/20

[58] Field of Search ..... 116/202, 286; 340/641, 340/642; 315/88, 89; 362/20, 254; 354/148; 307/139

[56] References Cited

U.S. PATENT DOCUMENTS 3,855,587 12/1974 Jacobs ..... 340/641

*Primary Examiner*—Daniel M. Yasich

*Attorney, Agent, or Firm*—Fulbright & Jaworski

[57] ABSTRACT

A position sensor for a rotatable lamp changer turret having a plurality of lamps which are rotated in sequence to an operating position as the lamps burn out. A circular cam is positioned on the turret that includes a first position indicating portion for each of the lamps for indicating when each of the lamps is in the operating position. The cam includes a second position indicating portion for indicating that all of the lamps have been rotated past the operating position. The second position indicating means is located for stopping the turret in a position with all the lamps out of the operating position for providing a visual alarm indication. A cam follower engages the cam and in turn actuates electrical switch means for controlling rotation of the turret. A third cam portion is positioned between each of the first cam portions for actuating the cam follower and the switch means for maintaining turret rotation until the first cam portions are engaged by the cam follower.

2 Claims, 7 Drawing Figures

Fig. 1
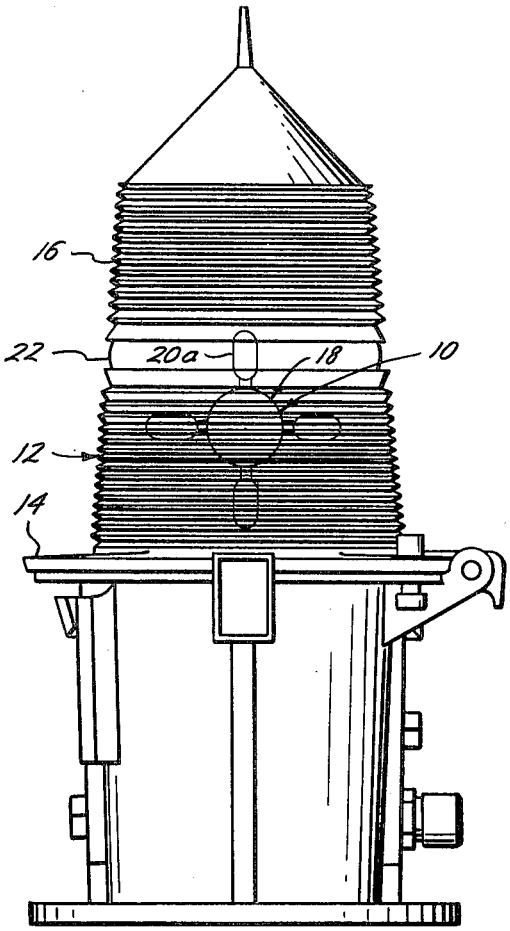
Fig. 2
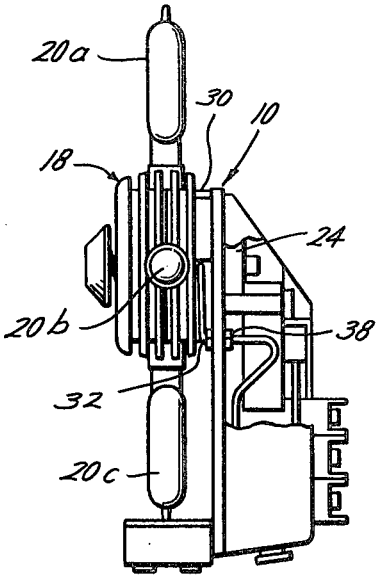
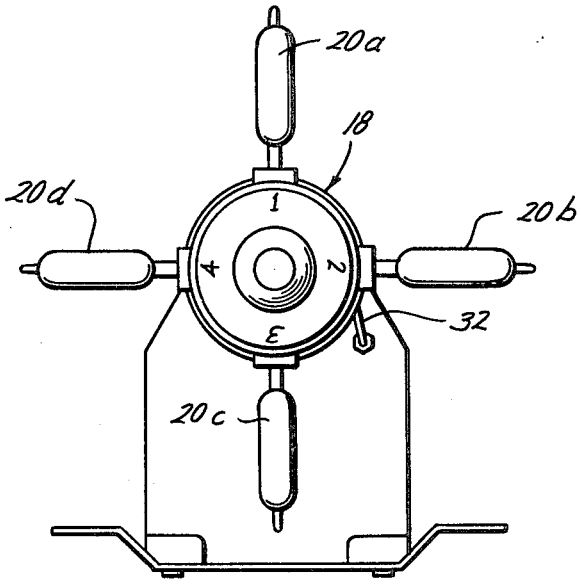
Fig. 3

POSITION SENSOR FOR ROTATABLE LAMP CHANGER TURRET

BACKGROUND OF THE INVENTION

Generally, it is old, as illustrated in U.S. Pat. No. 3,855,587, to provide a light, such as a navigational light with a lamp changer having a rotatable turret holding a plurality of lamps in which the turret rotates to place a new lamp into the operating position when one lamp burns out.

The present invention is directed to providing a position sensor for controlling the operation of a motor which rotates the turret to insure that the lamps are accurately positioned in the operating position, which stops rotation of the turret when all of the lamps have burned out, and which provides a visual symbol or alarm when all of the lamps have burned out so that they may be readily replaced.

SUMMARY

One feature of the present invention is the provision of a position sensor, for a rotatable lamp changer turret having a plurality of lamps which are rotated in sequence to an operating position when one of the lamps burns out, of a first position indicating means for each of the lamps connected to the turret for indicating and insuring that each of the lamps accurately moves into the operating position.

Another feature is the provision of second position indicating means on the turret for indicating when all of the lamps have burned out and rotated past the operating position for positioning the turret in an unnormal position to provide a visual alarm or indication that the lamps need changing. Actuating means engage and are actuated by the first and second position indicating means as the turret rotates, and in turn is connected to switch means for controlling the rotation of the turret.

A further object of the present invention is the provision of a first switch having first and second positions in which the second position is adapted to actuate a motor for rotating the turret, a second switch means having first and second positions in which the second position is adapted to deactuate a motor that rotates the turret, and a cam follower which engages and actuates the first and second switch means in response to movement of the follower. A circular cam is positioned on the turret for engaging and actuating the follower. The cam includes a first position indicating portion for each lamp which engages the follower when a lamp is in the operating position for causing th follower to actuate the first switch to the first position. The cam includes a second position indicating portion engaging the follower when all of the lamps have been rotated past the operating position for causing the second switch means to move to the second position. The cam includes a third cam portion between each of the first cam portions for engaging the follower while the turret is rotating for causing the first switch means to move to the second position.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 1 is an elevational view of the use of the present invention in a navigational light;

FIG. 2 is an enlarged side elevational view of the lamp changer of the present invention, FIG. 3 is a front elevational view of the lamp changer of the present invention in normal operation.

DESCRIPTION OF THE PREFERRED EMBODIMENT

Figure 4:
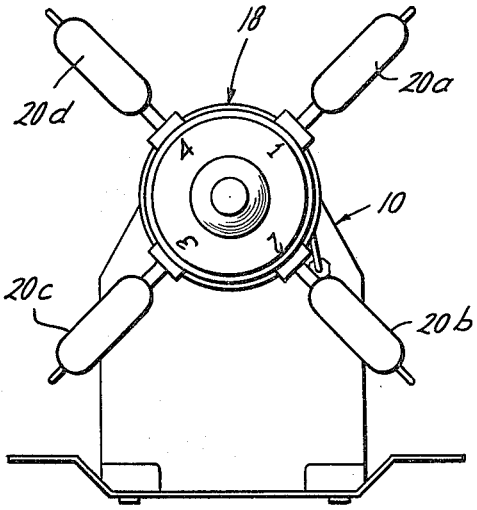
FIG. 4 is a front elevational view of the lamp changer of the present invention in position when all of the lamps have burned out.

Referring now to the drawings, and particularly FIGS. 1, 2, and 3, the reference numeral 10 generally indicates the lamp changer of the present invention shown used in a navigational light, generally indicated by the reference numeral 12, having a base 14 and a lens 16. The lamp changer 10 includes a rotatable turret 18 holding a plurality of lamps 20*a*, 20*b*, 20*c* and 20*d*, in which one of the lamps such as the upper lamp 20*a* is in the operating position at the focal point 22 of the lens 16. When the lamp 20*a* in the operating position burns out, the rotatable turret 18 is actuated by a motor 24 to rotate a new lamp 20*b* into the operating position.

It is to be noted from FIGS. 1–3 that in normal operation the lamps 20*a*–20*d* are vertically and horizontally positioned in the form of a "+". The present invention is directed to providing a position sensor which may be used with any suitable lamp changer circuit such as that described in U.S. Pat. No. 3,855,587 which is incorporated herein by reference, for controlling the actuation of the motor 24 which rotates the turret 18. In addition, the present sensor actuates the motor 24 to insure that the lamps 20*a*–20*d* are accurately placed in the operating position as shown in FIGS. 1–3. In the event that all of the lamps 20*a*–20*d* burn out the turret 18 will be rotated to a position to form a visual "X", as best seen in FIG. 4, whereby upon visual inspection of the lamp changer 10 during the daytime, it can be quickly and easily ascertained that all of the lamps 20*a*–20*d* should be changed.

Figure 5:
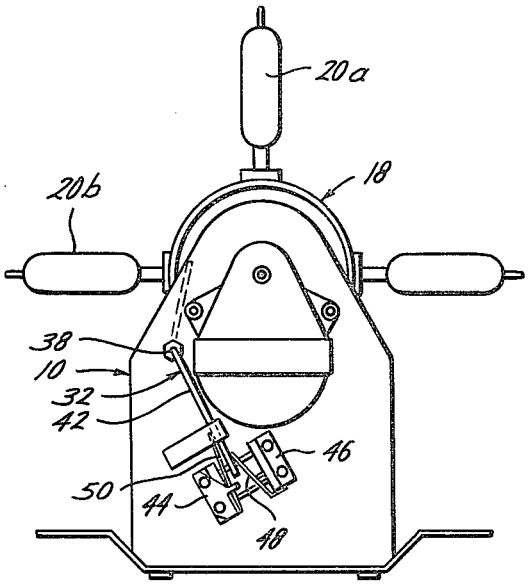
FIG. 5 is a rear elevational view of the lamp changer of the present invention.
Figure 6:
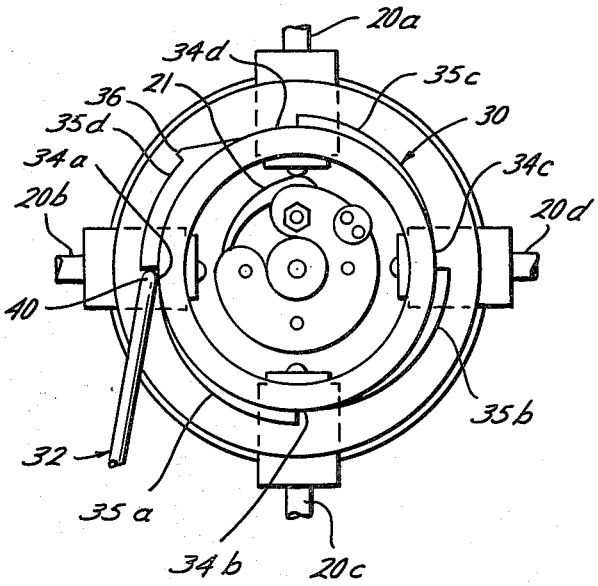
FIG. 6 is a fragmentary elevational view illustrating the position sensor of the present invention.
Figure 7:
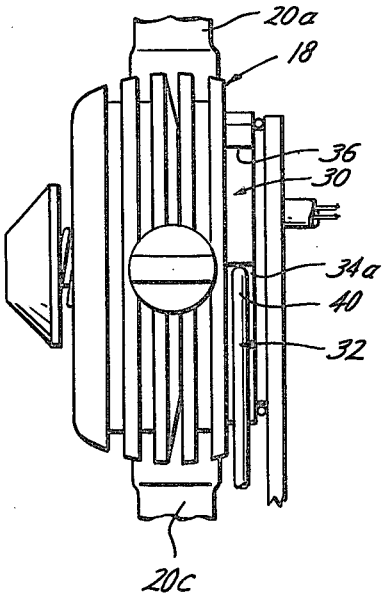
FIG. 7 is a side elevational view of the apparatus of FIG. 6.

As best seen in FIGS. 5–7, the position sensor generally includes a cam 30, a cam follower 32, and switch means actuated by the follower 32 and in turn controlling the actuation of the motor 24. The cam 30 includes a first position indicator or a first cam portion 34*a*, 34*b*, 34*c* and 34*d*, respectively, for each of the lamps 20*a*, 20*b*, 20*c* and 20*d*, respectively, for indicating when the respective lamps are in the operating positon. That is, when the free end 40 of the cam follower 32 engages the cam portion 34*a*, the first lamp 20*a* is in the operating position engaging power contacts 21. And when the operating lamp such as 20*a* burns out, the turret 18 will be rotated by the motor 24 in a clockwise direction as best seen in FIG. 6 until the next lamp 20*b* is rotated into the operating position as indicated by the free end 40 of the cam follower 32 engaging the position indicating portion 34*b*.

A second position indicating means or cam portion 36 is positioned on the cam 30 at a position so that when the cam portion 36 is in contact with the cam follower 32 all of the lamps 20a–20d will have rotated past the operating position. The cam follower 32 will then actuate switching means to shut off the motor 24 to prevent further rotation of the turret 18, and further will stop turret 18 in the position indicated in FIG. 4 whereby the lamps form a "X" to provide a visual indication that all of the lamps in the turret 18 are burned out.

The cam follower 32 is pivotally mounted in a rotatable bushing 38 and maintained against the surfaces of cam 30 by a leaf spring actuator 48 attached to the second switch 46 (FIGS. 2 and 5). One end 40 of the cam follower 32 engages the cam 30 and the second end 42 of the cam follower 32 is connected and actuates switch means such as a first switch 44 and a second switch 46. The second switch 46 includes a leaf spring actuator 48 and is a normally closed switch which is actuated to the open position when the first cam follower portion 40 engages the cam portion 36. First switch 44 includes a lever follower 50 engaging the second end 42 of the cam follower 32 and the first switch 44 is in a normally open position when the first end 40 of the cam follower engages cam portions 34a, 34b, 34c or 34d. The switches 44 and 46 are connected in any suitable lamp changer control circuit for controlling actuation of the motor 24 and thus rotation of the turret 18.

A third position indicating means or cam portions 35a, 35b, 35c and 35d are provided on the cam 30 between each of the first cam portions 34a–34d for actuating the cam follower 32 and first switch 44 to a normally closed position for insuring the continued rotation of the motor 24 and turret 18 until the free end 40 of the cam follower 32 reaches one of the first cam portions 34a–34b thereby insuring that a lamp is rotated into the correct operating position.

In use, the lamp changer is first in the position indicated in FIGS. 1–3 and 5–7 with the lamp 20a in the operating position contacting electrical power contacts 21. When the lamp 20a burns out, a lamp changer control circuit senses the burned out lamp, causing the turret 18 to rotate to place the lamp 20b into the operating position. The free end 40 of the cam follower 32 follows the cam 30 and is actuated by cam portion 35a to actuate the first switch 44 to a normally closed position for indicating that the lamp 20b has not yet reached its operating position therby maintaining rotation of the turret 18. When the lamp 20b is rotated to the operating position, the free end 40 of the cam follower 32 engages the first position indicating cam portion 34b opening the switch 44 thereby stopping rotation of the turret in the proper operating position. Similarly, lamps 20c and 20d are rotated into the operating position in sequence as lamps 20b and 20c burn out. After the last lamp 20d burns out, rotation of the turret 18 causes the second position indicating cam portion 36 to engage the free end 40 of the cam follower 32 to actuate the second switch 46 to an open position stopping rotation of the turret 18 in the position shown in FIG. 4. Therefore, the turret 18 is stopped in the form of a visual "X" to provide a visual indication that all of the lamps are burned out and should be changed.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are emcompassed within the spirit of the invention and the scope of the appended claims.

What is claimed is:

1. A position sensor for a rotatable lamp changer turret having having a plurality of lamps which are controllably rotated by a motor in sequence to an operating position as circuit means senses when at least one of the lamps burn out comprising, a circular cam positioned on the turret, said cam including first position indicating portion for each of the lamps for indicating when each of the lamps is in the operating position, said cam including a second position indicating portion for indicating that all of the lamps have been rotated past the operating position, a cam follower engaging said cam and actuated by said first and second position indicating portions as the turret rotates, electrical switch means connected to the cam follower and actuated for controlling the motor, and a third cam portion positioned between each of the first cam portions for actuating said cam follower and said switch means for actuating the motor until one of said first cam portions is engaged by the cam follower.

2. A position sensor for a rotatable lamp changer turret having a plurality of lamps which are controllably rotated by a motor in sequence to an operating position as circuit means senses when at least one of the lamps burn out comprising, a first switch means having first and second positions, said second position adapted to actuate said motor for rotating said turret, a second switch means having first and second positions, said second position adapted to deactuate said motor that rotates said turret, a cam follower engaging and actuating said first and second switch means in response to movement of the follower, a circular cam positioned on the turret engaging said follower, said cam including a first position indicating portion for each lamp which portion engages said follower when a lamp is in the operating position for causing said follower to actuate the first switch to the first position, said cam including a second position indicating portion engaging said follower when all of the lamps have been rotated past the operating position for causing said second switch means to move to the second position, and said cam including third cam portions between each of the first cam portions engaging said follower while the turret is rotating for causing said first switch means to move to the second position.

* * * * *